United States Patent [19]

Clachan et al.

[11] B 4,014,701

[45] Mar. 29, 1977

[54] PROCESS OF MAKING DIAZO-SENSITIZED FILM PRODUCTS USING HALOGEN CONTAINING PHENOLS AS COATING AID

[75] Inventors: Margaret Loudon Clachan; David Rankine Kennedy, both of Manningtree, England; Basil Robert Shephard, deceased, late of Manningtree, England; by Doreen Shephard, executrix, Colchester, England

[73] Assignee: Imperial Chemical Industries Limited, London, England

[22] Filed: Mar. 22, 1974

[21] Appl. No.: 453,960

[44] Published under the second Trial Voluntary Protest Program on April 13, 1976 as document No. B 453,960.

Related U.S. Application Data

[63] Continuation-in-part of Ser. No. 307,529, Nov. 17, 1972, abandoned, which is a continuation of Ser. No. 647,642, June 21, 1967, abandoned.

[30] Foreign Application Priority Data

June 27, 1966 United Kingdom ..... 28738/66
Sept. 8, 1966 United Kingdom ..... 40209/66

[52] U.S. Cl. ..... 96/75; 96/87 R; 427/307; 427/314; 427/407 G

[51] Int. Cl.[2] ..... G03C 1/80; G03C 1/52

[58] Field of Search ..... 96/75, 87 R, 91 R; 117/34; 427/307, 314, 407

[56] References Cited

UNITED STATES PATENTS

| | | | |
|---|---|---|---|
| 2,893,896 | 7/1959 | Beeber et al. | 117/118 |
| 2,984,569 | 5/1961 | Huys et al. | 96/87 R |
| 3,072,482 | 1/1963 | Beeber et al. | 96/75 |
| 3,506,445 | 4/1970 | Abbott et al. | 96/87 R |

FOREIGN PATENTS OR APPLICATIONS

| | | | |
|---|---|---|---|
| 966,258 | 8/1964 | United Kingdom | 96/75 |

OTHER PUBLICATIONS

Van der Grinter Bulletin, No. 78, 12/1964, pp. 1–8.

*Primary Examiner*—Charles L. Bowers, Jr.
*Attorney, Agent, or Firm*—Cushman, Darby & Cushman

[57] ABSTRACT

Process of producing diazo-sensitized film products which comprises pretreating the film surface with a halogen containing phenolic substance, coating with a plastics anchor layer and then coating with another plastics layer which includes or is impregnated with a light-sensitive diazonium compound.

5 Claims, No Drawings

PROCESS OF MAKING DIAZO-SENSITIZED FILM PRODUCTS USING HALOGEN CONTAINING PHENOLS AS COATING AID

This application is a continuation-in-part application of our copending application Ser. No. 307,529 filed Nov. 17, 1972, now abandoned which is a continuation application of now abandoned application Ser. No. 647,642 filed June 21, 1967.

This invention relates to diazo-sensitised film products.

It is known that self-supporting films of synthetic linear polyesters, particularly polyethylene terephthalate, may readily be prepared with mechanical, physical and chemical properties which make them very suitable as base materials for the production of photographic film materials, including those photographic film materials employing light-sensitive diazonium componds.

The term light-sensitive diazonium compound as used hereinafter relates not only to diazonium compounds per se but also to so-called polymeric diazonium compounds, that is to say diazonium compounds condensed with an aldehyde such as formaldehyde to produce a light-sensitive diazo resin.

To adapt a self-supporting polyester film for the purpose mentioned it is known to provide it with a coating of an organic film-forming material which contains a light-sensitive diazonium compound, or which is subsequently to be sensitised by impregnating with a light-sensitive diazonium compound.

There is however, a great difficulty in providing adequate anchorage of such coatings to the film base.

It has been suggested to overcome this difficulty by applying to the synthetic linear polyester film base an intermediate coating or coatings of an adherent polymeric material before applying the diazo-containing or diazo-receptive coating composition. But the number of materials having suitably tenacious adhesion to the polyester base is very limited and at best there is a tendency for the solvents of the diazo-containing, or diazo-receptive coating composition to loosen such intermediate coatings from the film base. The choice of materials for such intermediate coatings is further limited since extremely few are adapted to hold adherent to their surfaces a diazo-receptive or diazo-containing composition.

Various treatments of synthetic linear polyesters have been tried to improve the adherence to them of various organic coatings. These include treatment with compounds which have a swelling or solvent action on the synthetic linear polyester.

Those which substantially improve the adherence of coatings are generally inconvenient in use, for example the well-known halogenated fatty acids have the disadvantage of corroding the materials with which film coating plant is generally constructed.

Thus the various methods, hitherto tried, of achieving the bonding of the resinous compositions, which contain or which are receptive to light-sensitive diazo compounds, to synthetic linear polyester film have not proved entirely satisfactory.

It is an object of the present invention to provide a new method of preparing synthetic linear polyester film to obtain anchorage of organic coatings which are receptive to, or which contain, diazo compounds and thereby to provide new diazo-sensitised film products.

According to the present invention, there is provided a process for the production of a diazo-sensitised film product, which comprises the successive steps of:

I. treating a self-supporting film of synthetic linear polyester by applying to at least one surface thereof a solution consisting of:

i. a liquid solvent which is volatile in the temperature range 30°–120°C, and ii. 0.5–20% by weight of halogen-containing phenolic substance in solution therein, the molecules of the said substance containing one benzenoid ring and one or two hydroxyl groups and one or more chlorine or bromine atoms all of which are attached directly to carbon atoms belonging to the benzeoid ring;

II. heating the treated film for 1–5 minutes at 30°–120°C to remove the volatile solvent;

III. superimposing on a treated surface of the film a layer consisting essentially of one of the following:

1. a vinyl chloride-vinyl acetate copolymer or partially hydrolysed vinyl chloride-vinyl acetate copolymer,
2. a vinylidene chloride-acrylonitrile copolymer or a copolymer of vinylidene chloride with an acrylic or methylacrylic ester,
3. a cellulose nitrate or cellulose acetate butyrate, or
4. a polymer of acrylic or methacrylic acid or ester, or a copolymer of these acids or esters with other vinyl unsaturated monomers;

IV. and thereafter applying over the said layer (1), (2), (3) or (4) one of the following:

A. a layer of cellulose acetate cellulose acetate butyrate, polyvinylacetal, polyvinyl acetate or partially hydrolysed polyvinyl acetate which layer comprises a light-sensitive diazonium compound, B. a layer of cellulose acetate, cellulose acetate butyrate, polyvinylacetal, polyvinyl acetate or partially hydrolysed polyvinyl acetate followed by impregnation of the said layer with a light-sensitive diazonium compound, or C. a layer of cellulose acetate or cellulose acetate butyrate, followed by surface hydrolysis of said layer and impregnation of said hydrolysed surface with a light-sensitive diazonium compound.

The treatment with the halogen-containing phenolic substance may be effected at a temperature of at least 30°C.

The term volatile medium as used herein means a liquid medium which is volatile in the temperature range 30°–120°C to the extent that coatings of solutions or dispersions in the medium may be dried sufficiently by heating for 1–15 minutes at 30°–120°C. Examples of media are set forth later herein.

For the purpose of this invention the term "halogen-containing phenolic substance" is intended to comprise chemical compounds whose molecules contain at least one benzenoid ring or fused benzenoid ring, and one or more hydroxyl groups and one or more halogen atoms which are attached directly to carbon atoms belonging to a benzoid or fused benzoid ring or rings. The following are examples of such halogen-containing phenolic substances; ortho-chlorophenol; para-chlorophenol; 2,4-dichlorophenol; 2,4,5-trichlorophenol; 2,4,6-trichlorophenol; 2,3,4,6-tetrachlorophenol; pentachlorophenol; 2,4-dichloro-5-methyl phenol; 2,4-dichloro-3,5-dimethyl phenol; 4-chloro-2-phenyl phenol; 2-benzyl-4-chlorophenol; 2,2'-dichloro-4,4'-diphenol; 2,2'-methylene-bis-(4-chlorophenol); 4-chloro-1-naphthol; 3,5-dichloro-salicylic acid; 2-4-dibromophenol; 2,4,6-tribromophenol; isopropylidene-di-(2,5-dichlorophenol); p-chloro-o-benzyl phenol; p-chloro-m-cresol; 4-chlororesorcinol.

A synthetic linear polyester film material prepared as described will accept on the surface a layer 1, 2, 3, 4 or 5 and hold strongly adherent thereto a layer consisting essentially of a cellulose acetate or cellulose acetate butyrate. The layer may afterwards be hydrolysed on its outer surface and then impregnated with a light-sensitive diazonium compound, or may be directly impregnated with a light-sensitive diazonium compound, contained in a solvent medium having some swelling action on the layer, or alternatively the layer, as applied, may contain a light-sensitive diazonium compound, to produce a final product which is a light-sensitive diazotype film.

Likewise, a synthetic linear polyester film material prepared as described will accept on the surface a layer 1, 2, 3, 4 or 5 and hold strongly adherent thereto a layer consisting essentially of a polyvinylacetal, or a polyvinyl acetate or partially hydrolysed polyvinyl acetate which includes a light-sensitive diazonium compound or which may subsequently be impregnated with a light-sensitive diazonium compound, to produce a final product which is a light-sensitive diazo-type film.

The polyvinylacetal may be, for example, a formaldehyde-, acetaldehyde-, or butyraldehyde-acetal of a polyvinyl alcohol containing some acetate groups.

The film of synthetic linear polyester is preferably a film formed from polyethylene terephthalate and it is preferably one which has been molecularly oriented by stretching in one direction or in two directions at right angles. Such synthetic linear polyester film materials are readily available commercially.

The treatment may conveniently consist of applying to the synthetic linear polyester film surface a solution of any one or several of the exemplified halogen-containing phenolic substances in suitable volatile media, such as those containing lower ketones, lower alcohols or chlorinated hydrocarbons, or dilute aqueous solutions of volatile bases such as dilute ammonia, by using any of several well-known coating procedures such as dip or bead application, and then heating the film for a short time at an elevated temperature to remove the volatile solvents and allow the halogen-containing phenolic substance to swell the film surface to some extent.

It is generally preferred to treat the synthetic linear polyester film base by coating it with a solution of 2,4,6-trichlorophenol, 2,4,5-trichlorophenol or 2,4-dichlorophenol, or a binary mixture of these substances, in suitable volatile solvents, these substances or binary mixtures constituting 0.5–20% by weight of the treating solution, and then to heat the film for 1–15 minutes, at 30°–120°C.

In a modification of the process of the invention the materials of the defined layers 1, 2, 3, 4 or 5 may be applied in combination with any one or several of the halogen-containing phenolic substances, as a single treatment of the synthetic linear polyester film, before applying any of the coatings A, B or C.

The diazo-sensitised film product resulting from the use of layer (C) when the diazonium compond is a polymeric diazonium compound may be used as a negative working pre-sensitised lithographic plate.

The following examples will serve to illustrate the invention.

EXAMPLE 1

Biaxially oriented polyester film was treated by coating with a solution as follows:

| | |
|---|---|
| 2,4-dichlorophenol | 2.5 g |
| 2,4,6-trichlorophenol | 2.5 g |
| VAGH (a commercially available partially hydrolysed vinyl chloride-vinyl acetate copolymer) | 0.5 g |
| Acetone | 100 ml |

The coating was dried for 5 minutes at 105°C.

It was found that when a layer approximately 4.5 microns thick, composed of "Vinnapas" UV50 (a commercially available partially hydrolysed polyvinyl acetate) and 4-benzoylamide-2,5-di-n-propoxy benzene diazonium chloride-zinc chloride double salt, was applied for an ethanol-water solvent mixture, this layer adhered strongly to the film base initially during, and after processing and image development.

EXAMPLE 2

The following solution was applied to oriented polyester film:

| | |
|---|---|
| 2,4-dichlorophenol | 5.0 g |
| 2,4,6-trichlorophenol | 5.0 g |
| "Saran"F220 (a commercially available vinylidene chloride-acrylonitrile copolymer) | 2.0 g |
| Acetone | 100 ml |

and dried for 5 minutes at 105°C.

A layer of secondary cellulose acetate was then applied to the so treated polyester film base. This acetate layer was then hydrolysed on its outer surface by known methods using a caustic soda in methanol solution to a depth of about 4 microns and throughout the hydrolysis process the adhesion of the cellulose acetate to the film base remained good. The hydrolysed cellulose acetate layer was then sensitised with an aqueous solution of 4-N-N-dibenzylamino-3-chlorobenzene diazonium chloride-zinc chloride double salt, and dried without affecting the adhesion to film base.

Alternatively it was found that a layer of cellulose acetate butyrate could be applied to the treated base and the outer surface of the cellulose acetate butyrate layer hydrolysed and diazo impregnated in a similar manner. This layer remained strongly adherent to the polyester base at all times.

EXAMPLE 3

Biaxially oriented polyester film was treated by coating with solutions as follows:

| | |
|---|---|
| Coat 1 | |
| p-chloro-o-benzyl phenol | 2.0 g |
| Methanol | 100 ml |
| Dried for 1 minute at 130°C | |
| Coat 2 | |
| Cellulose nitrate | 2.0 g |
| Hexamethoxy methyl melamine | 0.1 g |
| p-toluene sulphonic acid | 0.01 g |
| Methanol | 100 ml |
| Dried for 5 minutes at 105°C | |

It was found that, a layer of secondary cellulose acetate approximately 6 microns thick when applied to the so treated polyester film surface, adhered strongly to the film base, and the acetate layer could be impregnated directly with light-sensitive diazonium compounds contained in solvent media having a swelling action on the cellulose acetate without loss of adhesion of the layer to the film base.

It was found as an alternative that when a composition containing both diazo compounds and cellulose acetate was applied to the so treated surface as a single layer, this layer adhered well to the film base.

EXAMPLE 4

Biaxially oriented polyester film was treated with the following solution:

| | |
|---|---|
| 2,4-dichlorophenol | 5.0 g |
| "Bakelite" 5468/1 (a commercially available Novolak resin) | 0.5 g |
| Methanol | 100 ml |

and dried for 10 minutes at 120°C.

A layer of cellulose acetate was applied as in Example 1, and subsequently sensitised with a solution of diazonium compounds in a mixture of acetone, methanol and water. The adhesion of the sensitised layer to the film base was excellent.

EXAMPLE 5

Biaxially oriented polyester film was treated by coating with a mixture of solution as follows:

| | |
|---|---|
| Coat 1 | |
| 2,4,6-trichlorophenol | 2.5 g |
| 2,4-dichlorophenol | 2.5 g |
| Methanol | 100 ml |
| Dried for 2 minutes at 70°C | |
| Coat 2 | |
| A copolymer of methylmethacrylate (90 mole %) and N-methylol acrylamide (10 mole %) | 2.0 g |
| Acetone | 97 ml |
| Ethyl lactate | 3 ml |
| Dried for 10 minutes at 105°C | |

It was found that a light-sensitive coating as described in Example 4 adhered strongly to the so treated film base.

EXAMPLE 6

Biaxially oriented polyester film was treated by coating with a solution comprising:

| | |
|---|---|
| a) p-chloro-m-cresol | 5 g |
| Methanol | 100 ml |

and dried for 2 minutes at 65°C. It was then coated with a solution comprising:

| | |
|---|---|
| b) Cellulose acetate butyrate | 2.0 g |
| Acetone | 100 ml |

and dried for 5 minutes at 100°C.

It was found that when a layer approximately 4 microns thick composed of "Mowital" B20T (a commercially available polyvinyl butyral containing 29% polyvinyl alcohol and 1% polyvinyl acetate) and 4-diazo-N-N-diethylaniline 1:1 zinc chloride double salt, resorcinol, the sodium salt of 2,3-dihydroxy naphthalene-6-sulphonic acid, thiourea and citric acid in a mixture of acetone, methanol and 2-methoxy ethyl acetate was applied, the layer adhered strongly to the film base initially, during and after processing and image development.

EXAMPLE 7

Biaxially oriented polyester film was treated by coating with a solution as follows:

| | |
|---|---|
| 2,4-dichlorophenol | 2.5 g |
| 2,4,6-trichlorophenol | 2.5 g |
| VAGH (a commercially available partially hydrolysed vinyl chloride-vinyl acetate copolymer) | 0.5 g |
| Acetone | 100 ml |

The coating was dried for 5 minutes at 105°C.

A layer of "Formvar" 1595E (a commercially available polyvinyl formal containing 9–13% polyvinyl acetate and 5–6% polyvinyl alcohol) about 4 microns thick was then applied and adhered strongly. The polyvinyl formal layer was then impregnated with the following solution:

| | |
|---|---|
| 2,3-dihydroxy naphthalene-6-sulphonic acid | 4.0 g |
| 4-diazo-N-N-diethylaniline 1:1 zinc chloride double salt | 4.0 g |
| Resorcinol | 0.75 g |
| Thiourea | 1.0 g |
| Citric acid | 2.0 g |
| Formic acid | 15 ml |
| Acetone | 30 ml |
| 2-methoxy-ethanol | 20 ml |
| Water | 35 ml |

The diazo-sensitised layer adhered strongly to the base and there was no loss of adhesion after image development.

EXAMPLE 8

The following solution was applied to oriented polyester film:

| | |
|---|---|
| p-chloro-m-cresol | 10.0 g |
| "Saran" F220 (a commercially available vinylidene chloride-acrylonitrile copolymer) | 2.0 g |
| Acetone | 100 ml |

The coating was dried for 2 minutes at 80°C.

A layer of "Formvar" 770 (a commercially available polyvinyl formal containing 40–50% polyvinyl acetate and 5–6% polyvinyl alcohol) was applied to the so treated polyester film base. This layer was then impregnated with a solution of light-sensitive diazonium compounds contained in solvent media having a swelling action on the polyvinyl formal layer without loss of adhesion of the layer to the film base.

EXAMPLE 9

The following solution was applied to oriented polyester film:

| | |
|---|---|
| 2,4,6-trichlorophenol | 5.0 g |
| Cellulose nitrate | 1.0 g |
| Methanol | 100 ml |

The coating was dried for 2 minutes at 100°C.

A layer of "Alvar" 770 (a commercially available polyvinylacetal containing 6.5% polyvinyl alcohol and 28–30% polyvinyl acetate) was applied and adhered strongly to the base. This layer was further impregnated with a solution of light-sensitive diazonium salts, couplers and stabilisers in a mixture of acetone, methanol and water without affecting the adhesion to base.

EXAMPLE 10

Biaxially oriented polyester film was coated with an adherent "Saran" F220 layer as in Example 2. A layer of secondary cellulose acetate was applied thereto and the outer surface of this layer was hydrolysed with caustic soda/methanol solution also as in Example 2.

The thus hydrolysed acetate layer was then sensitised by applying a solution of "ZAL" (a commercially available diazonium diphenylamine formaldehyde resin) in a water/methanol solution.

After drying, the resulting film assembly was exposed to a negative transparency and after development a positive image of the original was formed on the assembly. This image was then inked and placed on an offset printing press and 1000 good copies of the original were produced without any of the image areas becoming detached.

The acetate layer therefore remained firmly adherent to the polyester base throughout hydrolysis, sensitisation, image development and printing operations.

EXAMPLE 11

Biaxially oriented polyester film was coated with an adherent "Saran" F220 layer as in Example 2. A layer of secondary cellulose acetate butyrate was applied thereto and the outer surface of this layer was hydrolysed with caustic soda/methanol solution also as in Example 2.

The thus hydrolysed acetate layer was then sensitised by applying a solution of "ZAL" (a commercially available diazonium diphenylamine formaldehyde resin) in a water/methanol solution.

After drying, the resulting film assembly was exposed to a negative transparency and after development a positive image of the original was formed on the assembly. This image was then inked and placed on an offset printing press and 1000 good copies of the original were produced without any of the image areas becoming detached.

The cellulose acetate butyrate layer therefore remained firmly adherent to the polyester base throughout hydrolysis, sensitisation, image development and printing operations.

EXAMPLE 12

The surface of a conventional biaxially oriented and heat set polyethylene terephthalate film was pretreated by coating with a solution comprising:

| | |
|---|---|
| 2,4-dichlorophenol | 1.0 g |
| 2,4,6-trichlorophenol | 1.0 g |
| Methanol | 100 ml |

The treated surface was dried for 5 minutes at 105°C.

The treated surface was then coated with a solution of the following composition:

| | |
|---|---|
| VAGH (a commercially available partially hydrolysed vinyl chloride-vinyl acetate copolymer) | 2.0 g |
| Acetone | 100 ml |
| Ethyl lactate | 3 ml |

The coating was dried for 5 minutes at 105°C.

A light-sensitive coating was then applied over the VAGH layer from the following solution:

| | |
|---|---|
| "Vinnapas" UV50 (a commercially available partially hydrolysed polyvinyl acetate) | 2.0 g |
| 4-benzoylamide-2,5-di-n-propoxy benzene diazonium chloride-zinc chloride double salt | 4.0 g |
| Ethanol | 50 ml |
| Water | 50 ml |

The coating was dried to give a layer 4.5 microns thick.

The light-sensitive layer adhered strongly to the polyester film prior to, during, and after processing and image development.

EXAMPLE 13

The surface of a conventional biaxially oriented and heat set polyethylene terephthalate film was pretreated with the chlorophenol mixture and then coated with the solution of VAGH as described in Example 12.

A layer about 6 microns thick of secondary cellulose acetate was applied from a solution in conventional manner over the VAGH layer.

The secondary cellulose acetate was then impregnated with a conventional sensitising solution containing a light-sensitive diazonium compound and a solvent. The adhesion of the impregnated layer to the polyester film was strong prior to, during, and after processing and image development.

EXAMPLE 14

In a modification of Example 13, the secondary cellulose acetate layer, instead of being impregnated with a sensitising solution, was further coated with a conventional light-sensitive layer comprising cellulose acetate, a light-sensitive diazonium compound and a solvent. The adhesion of the light-sensitive layer to the polyester film was excellent prior to, during, and after processing and image development.

EXAMPLE 15

The surface of a conventional biaxially oriented and heat set polyethylene terephthalate film was pretreated by coating with a solution comprising:

| | |
|---|---|
| 4-chlororesorcinol | 2.0 g |
| Methanol | 100 ml |

The treated surface was dried for 5 minutes at 105°C and was then coated with the following solution:

| | |
|---|---|
| "Saran" F220 (a commercially available vinylidene chloride-acrylonitrile copolymer) | 1.5 g |
| Methyl ethyl ketone | 100 ml |

A layer of secondary cellulose acetate was applied from solution in a conventional manner over the "Saran" layer and was then hydrolysed to a depth of about 4 microns by surface treatment with a caustic soda in methanol solution using known methods. The hydrolysis did not affect the adhesion of the coatings to the film surface.

The hydrolysed cellulose acetate layer was then sensitised by treatment with an aqueous solution of light-sensitive 4-N-N-dibenzylamino-3-chlorobenzene diazonium chloride-zinc chloride double salt and dried. The sensitised layer remained strongly adherent to the film under all conditions of use and treatment.

EXAMPLE 16

In a modification of Example 15, the hydrolysis of the secondary cellulose acetate layer and sensitisation were omitted and instead a further layer of cellulose acetate butyrate was applied from solution in a conventional manner over the cellulose acetate layer. The layer of cellulose acetate butyrate was then hydrolysed and sensitised by the materials and the procedure described in Example 15.

The sensitised cellulose acetate butyrate layer was strongly adherent to the polyester film under all conditions of use and treatment.

EXAMPLES 17 AND 18

Examples 15 and 16 were repeated except that the pretreating solution was of the following composition:

| | |
|---|---|
| p-chloro-m-cresol | 2.0 g |
| Methanol | 100 ml |

The overlying coatings and sensitised layers were strongly adherent to the film at all times.

EXAMPLE 19

The surface of a conventional biaxially oriented and heat set polyethylene terephthalate film was pretreated by coating with a solution comprising:

| | |
|---|---|
| p-chloro-m-cresol | 3.0 g |
| Methanol | 100 ml |

The treated film was dried for 5 minutes at 105°C.

The treated surface was then coated with a solution of the following composition:

| | |
|---|---|
| 'Diakon' MG100 (a commercially available methyl methacrylate polymer) | 2.0 g |
| Acetone | 100 ml |
| Ethyl lactate | 3 ml |

A layer of "Formvar" 1595E (a commercially available polyvinyl formal containing 9–13% polyvinyl acetate and 5–6% polyvinyl alcohol) about 4 microns thick was applied to the 'Diakon' layer and adhered strongly.

The "Formvar" layer was then impregnated with the following solution:

| | |
|---|---|
| 2,3-dihydroxy naphthalene-6-sulphonic acid | 4.0 g |
| 4-diazo-N-N-diethylaniline 1:1 zinc chloride double salt | 4.0 g |
| Resorcinol | 0.75 g |
| Thiourea | 1.0 g |
| Citric acid | 2.0 g |
| Formic acid | 15 ml |
| Acetone | 30 ml |
| 2-methoxy-ethanol | 20 ml |
| Water | 35 ml |

The sensitised layer adhered strongly to the film under all conditions of use and treatment.

EXAMPLE 20

Example 19 was repeated with the exception that the 'Diakon' MG100 layer was replaced by a "Saran" F220 layer which was applied from the solution specified in Example 15. The sensitised layer adhered well to the film under all conditions of use and treatment.

EXAMPLE 21

Example 19 was repeated with the exception that the 'Diakon' MG100 layer was replaced by a VAGH layer applied from the solution specified in Example 12. The sensitised layer adhered strongly to the film under all conditions of use and treatment.

We claim:

1. A process for the production of a diazo-sensitised film product, which comprises the successive steps of:

I. treating a self-supporting film of synthetic linear polyester by applying to at least one surface thereof a solution consisting of:
   i. a liquid solvent which is volatile in the temperature range 30°–120°C, and
   ii. 0.5–20% by weight of halogen-containing phenolic substance in solution therein, the molecules of the said substance containing one benzenoid ring and one or two hydroxyl groups and one or more chlorine or bromine atoms all of which are attached directly to carbon atoms belonging to the benzenoid ring;

II. heating the treated film for 1–15 minutes at 30°–120°C to remove the volatile solvent;

III. superimposing on a treated surface of the film a layer consisting essentially of one of the following:
   1. a vinyl chloride-vinyl acetate copolymer or partially hydrolysed vinyl chloride-vinyl acetate copolymer,
   2. a vinylidene chloride-acrylonitrile copolymer or a copolymer of vinylidene chloride with an acrylic or methacrylic ester,
   3. a polymer of acrylic or methacrylic acid or ester, or a copolymer of these acids or esters with other vinyl unsaturated monomers;

IV. and thereafter applying over the said layer (1), (2 ), or 3 (4) one of the following:
   A. a layer of cellulose acetate, cellulose acetate butyrate, polyvinylacetal, polyvinyl acetate or partially hydrolysed polyvinyl acetate which layer comprises a light-sensitive diazonium compound,
   B. a layer of cellulose acetate, cellulose acetate butyrate, polyvinylacetal, polyvinyl acetate or partially hydrolysed polyvinyl acetate followed by impregnation of the said layer with a light-sensitive diazonium compound, or
   C. a layer of cellulose acetate or cellulose acetate butyrate, followed by surface hydrolysis of said layer and impregnation of said hydrolysed surface with a light-sensitive diazonium compound.

2. A process according to claim 1, in which the halogen-containing phenolic substance consists of at least one compound having the formula:

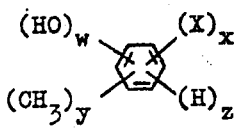

in which X is chlorine or bromine, $w$ is 1 or 2, $x$ is 1, 2, 3 or 4, $y$ is zero, 1 or 2, and $z$ is 1, 2 or 3.

3. A process according to claim 1, in which the halogen-containing phenolic substance consists of at least one compound having the formula:

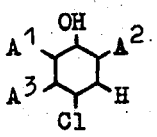

in which $A^1$ and $A^2$ are chlorine or hydrogen, and $A^3$ is hydroxy, chlorine, methyl or hydrogen.

4. A process according to claim 1, in which the halogen-containing phenolic substance consists of one or two of the following compounds:

2,4,6-trichlorophenol;
2,4,5-trichlorophenol;
2,4-dichlorophenol;
4-chloro-3-methylphenol;
4-chlororesorcinol.

5. A process according to claim 1, in which step (III) consists of superimposing on the treated surface of the film a layer consisting essentially of:

a vinylidene chloride-acrylonitrile copolymer or a copolymer of vinylidene chloride with an acrylic or methacrylic ester.

* * * * *

UNITED STATES PATENT OFFICE

CERTIFICATE OF CORRECTION

Patent No. 4,014,701 Dated March 29, 1977

Inventor(s) Margaret Loudon Clachan, David Rankine Kennedy, and Doreen Shephard (Executrix of Estate of Basil Robert Shephard).

It is certified that error appears in the above-identified patent and that said Letters Patent are hereby corrected as shown below:

IN THE HEADING

At Section [73] relating to Assignee, delete "Imperial Chemical Industries Limited", and insert therefore:

--Bexford Limited--.

Signed and Sealed this

Second Day of May 1978

[SEAL]

Attest:

RUTH C. MASON
Attesting Officer

LUTRELLE F. PARKER
Acting Commissioner of Patents and Trademarks